United States Patent [19]

Dzierson

[11] Patent Number: 4,747,163

[45] Date of Patent: May 31, 1988

[54] CYCLIST GLOVES

[76] Inventor: Mark A. Dzierson, 209 S. William St., Johnstown, N.Y. 12095

[21] Appl. No.: 31,244

[22] Filed: Mar. 26, 1987

[51] Int. Cl.[4] ..... A41D 19/00

[52] U.S. Cl. ..... 2/161 A; 2/164

[58] Field of Search ..... 2/161 A, 161 R, 164, 2/159, 20, 168, 16, 19

[56] References Cited

U.S. PATENT DOCUMENTS

| | | | |
|---|---|---|---|
| D. 230,913 | 3/1974 | Carter | D2/364 X |
| D. 236,044 | 7/1975 | Carter et al. | D2/361 |
| 2,258,999 | 10/1941 | Nunn | 2/159 |
| 2,302,875 | 11/1942 | Lykins | 2/161 A |
| 2,456,678 | 12/1948 | Cole | 2/161 A |
| 3,031,680 | 5/1962 | Compiano | 2/161 A |
| 3,881,197 | 5/1975 | Andrews | 2/161 A |
| 3,890,648 | 6/1975 | Beal | 2/20 |
| 3,890,649 | 6/1975 | Diggins | 2/161 A |
| 3,916,448 | 11/1975 | Hamel | 2/161 R |
| 4,000,903 | 1/1977 | Swanson | 2/161 A X |
| 4,089,070 | 5/1978 | Cherry | 2/161 A |
| 4,164,043 | 8/1979 | Fujita | 2/161 A |
| 4,183,100 | 1/1980 | DeMarco | 2/159 |
| 4,329,741 | 5/1982 | Bach | 2/161 A |
| 4,420,843 | 12/1983 | Genzling et al. | 2/161 A |
| 4,546,495 | 10/1985 | Castillo | 2/161 A |
| 4,561,122 | 12/1985 | Stanely et al. | 2/20 |
| 4,624,016 | 11/1986 | Luevano | 2/161 A |

OTHER PUBLICATIONS

Two pages from the Summer, 1986 retail sales catalog, issued by the Performance Bicycle Shop of Chapel Hill, N.C.

Two pages from the Summer, 1986 retail sales catalog, issued by the Bike Nashbar Company of Youngstown, Ohio.

*Primary Examiner*—Peter Nerbun

*Attorney, Agent, or Firm*—Stiefel, Gross & Kurland

[57] ABSTRACT

An improved glove for cyclists is disclosed. The glove comprises a flexible shell including a palm side, an outside, glove fingers and a glove thumb. Resilient padding is permanently secured to the palm side of the glove shell, and extends substantially from the heel of the palm side of the shell toward the glove fingers and across the crotch area between the glove index finger and the glove thumb. The padding comprises an elastomeric layer, a layer of fibrous batting, and an external layer.

7 Claims, 2 Drawing Sheets

CYCLIST GLOVES

BACKGROUND OF THE INVENTION

1. Field of the Invention

This invention relates to cyclist gloves. More particularly, it relates to improved cyclist gloves especially suitable for long distance cycling.

2. Description of Related Art

During long-distance cycling, and especially in long-distance cycling competition, various problems are encountered. For instance, the body-weight pressure on the handlebars tends to produce cramps in the cyclist's hands. Repeated shocks from the road surface contribute to fatigue. Continuous pressure of the handlebar against the palm of the hand also leads to blistering, particularly in the crotch area between the thumb and index finger.

While cyclist gloves made of leather have been utilized in an attempt to ameliorate the foregoing problems, such gloves have not been altogether successful. Because of the continued movement of the cyclist's hands there is a tendency for the leather to stretch, particularly in the palm area. This eventually results in the creation of a crease or fold in the leather palm of the glove. The crease tends to rub and abrade the cyclist's palm, eventually resulting in blisters.

SUMMARY OF THE INVENTION

The present invention provides an improved glove for cyclists. The glove comprises a flexible shell including a palm side, an outside, glove fingers and a glove thumb. A layer of resilient padding is permanently secured to the palm side of the glove shell. The padding layer extends substantially from the heel of the palm side of the shell toward the glove fingers and across the crotch area between the glove index finger and the glove thumb. The resilient padding layer comprises an elastomeric layer, a layer of fibrous batting, and an external layer.

BRIEF DESCRIPTION OF THE DRAWINGS

My invention will be best understood by the following detailed description taken in conjunction with the accompanying drawings wherein.

DETAILED DESCRIPTION OF THE INVENTION

Figure 2:
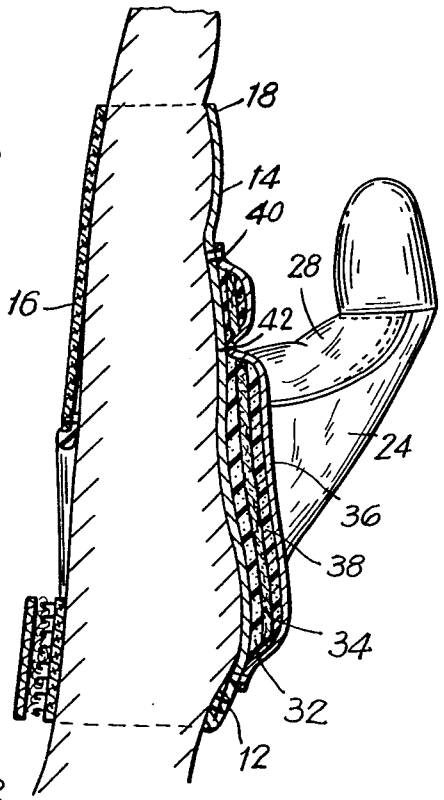
FIG. 2 is a sectional view taken substantially along the line 2—2 of FIG. 1.

The cyclist's glove of my invention is generally designated by the reference numeral 10. Glove 10 is made up of a flexible shell 12 having a palm side 14 and an outside 16. The shell defines glove fingers 18 and glove thumb 20. The outside 16 of shell 12 is preferably an open mesh fabric to provide ventilation. Desirably, glove thumb 20 of shell 12 also includes a portion 22 comprising an open mesh knit fabric secured between thumb portions 24 and 26, as by stitching. An open mesh knitted fabric is particularly suitable for outside 16 and thumb portion 22. The remainder of the shell 12 as well as the glove thumb portions 24 and 26 are preferably made of leather.

Figure 1:
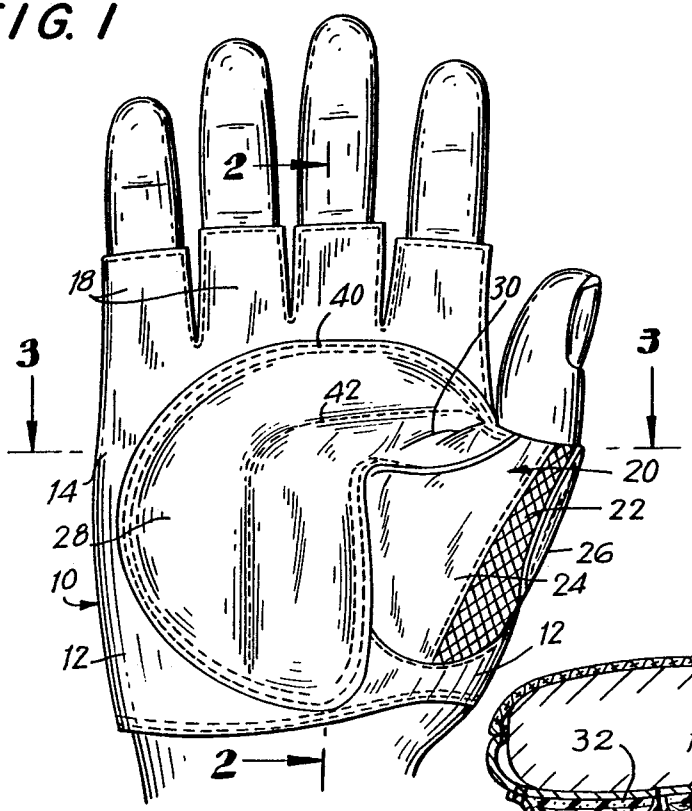
FIG. 1 is a perspective view of a cyclist's gloved hand as seen from the palm side.
Figure 3:
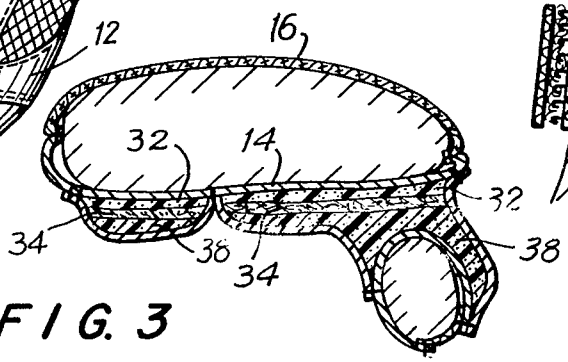
FIG. 3 is a sectional view taken substantially along the line 3—3 of FIG. 1.
Figure 6:
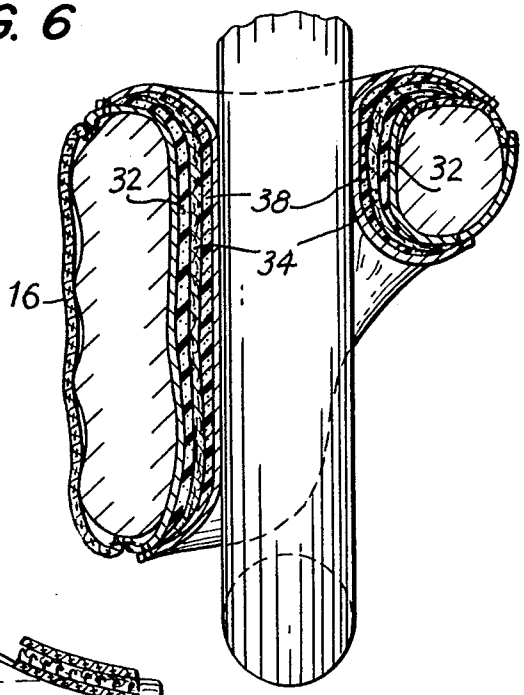
FIG. 6 is a sectional view taken substantially along the line 6—6 of FIG. 5.
Figure 5:
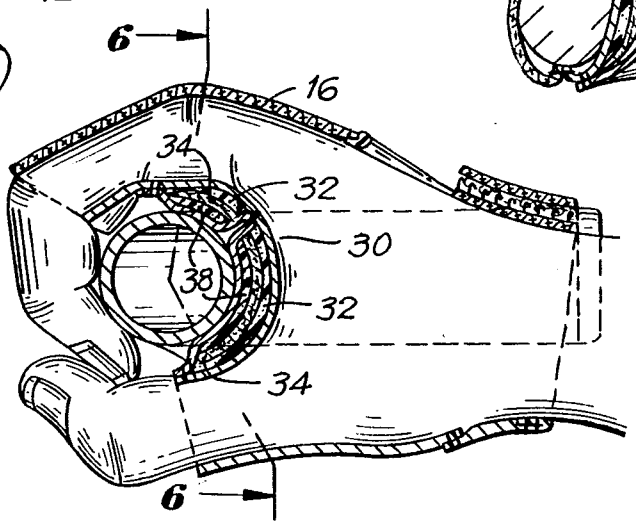
FIG. 5 is a top plan view in partial section viewed in the direction of line 5—5 of FIG. 4.
Figure 4:
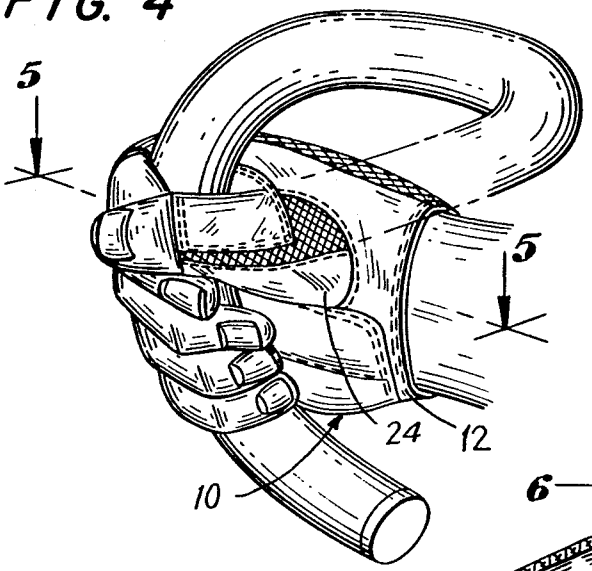
FIG. 4 is a perspective view of the cyclist's gloved hand gripping the handlebar of the cycle.

Permanently secured to the palm side 14 of the shell 12 is resilient padding 28. As best seen in FIGS. 1 and 5, resilient padding 28 extends from the heel of the palm side 14 toward glove fingers 18, and across the crotch 30 (FIG. 5) between the thumb 20 and index finger.

As shown in FIG. 2, the resilient padding 28 comprises an elastomeric layer 32, a layer of fibrous batting 34, and an external layer 36 which preferably is made of leather. Fibrous batting layer 34 is disposed between elastomeric layer 32 and external layer 36.

Preferably the elastomeric layer 32 is made of a foamed elastomer such as foam rubber. The fibrous batting layer 34 may be made of any suitable fibrous material. A particularly desirable fibrous material is made from polyolefin and polyester and is sold by 3M under its designation "Thinsulate."

If desired, resilient padding 28 may also comprise an intermediate layer 38 between external layer 36 and fibrous batting layer 34. Such intermediate layer 38 serves to further prevent friction and consequent blister formation. Preferably 1 such intermediate layer 38 is made of brush nylon.

Stitching 40, 42 serves to firmly secure the padding 28 to the glove palm side 14. The stitching 42 also insures that there is no relative lateral movement of the various layers making up padding 28.

The glove of my invention has been tested in marathon cycling and has been shown to markedly reduce the tendency of the cyclist's hands to become fatigued, to cramp, and to blister, particularly in the crotch and palm areas of the hand. Thus, the elastomeric layer 32 in resilient padding 28 tends to absorb road shocks to thereby reduce fatigue and blistering. The fibrous batting layer 34 disposed between elastomeric layer 32 and the palm side 14 of the glove shell permits pressure to be transmitted to the padded area without consequent stretching of leather layers 14 and 36. Fibrous batting layer 34 also reduces friction resulting from movement of the cyclist's hands, thereby reducing the tendency of the leather palm side 14 of the shell 12 to stretch and form a crease or fold which could promote blistering.

Having thus described my invention, what is claimed is:

1. A cyclist glove comprising a flexible shell including a palm side, an outside, glove fingers, and a glove thumb, said palm side of said shell having permanently secured thereto a layer of resilient padding extending from the heel of said palm side toward said glove fingers and across the crotch between the glove index finger and said glove thumb, said resilient padding layer comprising an elastomeric layer, an external layer, and a fibrous batting layer disposed between said elastomeric layer and said external layer.

2. The glove of claim 1 wherein said elastomeric layer comprises a foamed elastomer.

3. The glove of claim 2 wherein said elastomeric layer is foam rubber.

4. The glove of claim 2 wherein said fibrous batting layer comprises polyolefin and polyester fibers.

5. The glove of claim 1 wherein said palm side of said flexible shell and said external layer are made at least in part of leather.

6. The glove of claim 5 wherein said outside of said shell and a portion of said glove thumb comprise an open mesh fabric.

7. The glove of claim 1 wherein said resilient padding layer additionally comprises a fibrous intermediate layer between said fibrous batting layer and said external layer.

* * * * *